United States Patent [19]

Carney, III

[11] Patent Number: 4,645,375

[45] Date of Patent: Feb. 24, 1987

[54] STATIONARY IMPACT ATTENUATION SYSTEM

[75] Inventor: John F. Carney, III, Nashville, Tenn.

[73] Assignee: State of Connecticut, Hartford, Conn.

[21] Appl. No.: 737,273

[22] Filed: May 23, 1985

[51] Int. Cl.[4] ..... E01F 15/00

[52] U.S. Cl. ..... 404/6; 404/9; 256/13.1; 188/377

[58] Field of Search ..... 404/6, 12, 13, 9, 10; 256/1, 13.1; 188/371, 377

[56] References Cited

U.S. PATENT DOCUMENTS

| | | | |
|---|---|---|---|
| 3,141,655 | 7/1964 | Platt | 256/13.1 X |
| 3,643,924 | 2/1972 | Fitch | 256/13.1 |
| 3,674,115 | 7/1972 | Young et al. | 404/6 X |
| 3,845,936 | 11/1974 | Boedecker, Jr. et al. | 404/6 X |
| 3,880,404 | 4/1975 | Fitch | 404/6 X |
| 3,944,187 | 3/1976 | Walker | 256/13.1 |
| 4,200,310 | 4/1980 | Carney, III | 293/132 X |
| 4,452,431 | 6/1984 | Stephens et al. | 404/6 X |

FOREIGN PATENT DOCUMENTS

| | | | |
|---|---|---|---|
| 3106694 | 9/1982 | Fed. Rep. of Germany | 256/13.1 |

*Primary Examiner*—Stephen J. Novosad
*Assistant Examiner*—John F. Letchford
*Attorney, Agent, or Firm*—Arthur E. Fournier, Jr.

[57] ABSTRACT

A stationary impact attenuation system (10) for reducing the severity of vehicular collisions occasioned by an errant vehicle striking an immovable object. The subject stationary impact attenuation system (10) includes support means (14), impact attenuating means (12) and protective means (16). The support means (14) is located in juxtaposed relation to an immovable object and so as to lie between the immovable object and an oncoming errant vehicle. The impact attenuating means (12) is positioned in supported relation on the support means (14) and is selectively operative to entrap an errant vehicle striking the stationary impact attenuation system (10) at a first location and to redirect an errant vehicle striking the stationary impact attenuation system (10) at a second location. The protective means (16) is positioned in juxtaposed relation to the impact attenuating means (12) and is operative to prevent the buildup of snow and ice on the other components that comprise the stationary impact attenuation system (10).

10 Claims, 9 Drawing Figures

STATIONARY IMPACT ATTENUATION SYSTEM

The United States Government has rights in this invention pursuant to an Agreement between the Connecticut Department of Transportation and the Federal Highway Administration.

BACKGROUND OF THE INVENTION

The present invention is directed to a stationary impact attenuation system, and more particularly to an energy absorbing system of the type that is employable for purposes of reducing the severity of vehicular collisions, especially of the kind involving fast moving motor vehicles and stationary objects, from the standpoint of limiting the extend of injury suffered by people and the damage done to the vehicles and the objects struck thereby.

It has long been known in the prior art to employ accident preventative measures in an effort to prevent and/or reduce the damage incurred by both humans and property resulting from vehicular collisions occurring on the Nation's major highways as well as its local roads. Such accident preventative measures may be classifiable for purposes of this discussion into basic categories; namely, warning devices designed to be operative to forestall the occurrence of a vehicular collision, and protective devices designed to afford protection to both persons and property in the event of the occurrence of a vehicular collision.

By way of exemplification and not limitation, the category of warning devices is intended to include such items as conventional traffic signs and traffic signals, emergency signs and signals displayed to warn of the temporary existence of a dangerous situation, etc. Protective devices fall into two classes, i.e., those embodied in a vehicle as part of the construction of the vehicle, irrespective of whether the latter are subsequently affixed in some manner to the exterior of the vehicle. Examples of protective devices, which fall within the first class, are such things as padded dashboards, seat belts, etc. In the second class are to be found such things as various types of safety barriers designed to afford protection in the event of a vehicular collision between a moving vehicle and another moving vehicle, or between a moving vehicle and an immovable object. The present invention relates to a protective device of the type falling within the second class thereof as defined hereinabove, and more specifically, to such a device which is designed to afford protection in the event of a collision between a moving vehicle and an immovable object.

That there exists along the Nation's major highways and along its local roads a potential for danger has long been known. In this regard, one such potential for danger which one often encounters while traveling along the Nation's major highways and its local roads is that of the hazardous conditions occasioned by the presence on such highways and roads of men and equipment engaged in highway and road maintenance and repair operations. Such personnel and equipment need to be protected from being struck by an errant moving vehicle. More specifically, what is needed to provide such protection is an energy absorbing barrier which is portable in nature.

Although a great deal of the focus of the prior art heretodate has been directed towards providing various kinds of stationary energy absorbing barriers, there is known to exist in the prior art at least two different types of portable energy absorbing barriers, the latter more commonly being viewed as comprising a system. One such portable energy absorbing system is in the form of a hydro-cell system and consists of five rows of thirteen polyvinyl chloride plastic cells enveloped in a corset-like membrane. The entire unit is mounted on a metal platform, which is designed to be attached to the rear of a highway service vehicle. Each cell contains approximately three and one-half gallons of a water-calcium chloride solution. The latter solution functions to provide the system with the desired controlled crushing characteristics. The hydro-cell portable energy absorbing system, although being portable in nature and relatively easy to install has been found to suffer from the major disadvantage that it cannot simultaneously satisfy the energy absorption and minimum stopping distance, i.e., deceleration requirements, for moving vehicles impacting thereagainst at speeds in excess of thirty miles per hour.

Another known form of portable energy absorbing system is the modular crash cushion system, which is composed of thirty steel drums, i.e., ten rows with three drums per row. The thirty drums rest on a trailer, which is designed to be attached to a highway service vehicle at five points to provide the required degree of horizontal and vertical stability during impact. The principal disadvantage of the module crash cushion portable energy system stems from the fact that it is nineteen and one-half feet long. As a consequence, because of the need to maintain a rigid interconnection between the trailer and the towing service vehicle at all times, this system has been shown to suffer from severe wear limitations as concerns both the trailer on which the drums rest and the service vehicle which tows the trailer. In addition, because of its relatively long length, this system has proven to be unsuitable for use on the hilly and curved sections of highways and roads, which are found to exist in many areas of the country.

Yet another example of a prior art form of portable energy absorbing system, and one that has found favor with those who have a need for such systems, is that which forms the subject matter of U.S. Pat. No. 4,200,310, which issued on Apr. 29, 1980 to the same inventor as that of the present application and which is assigned to the same assignee as the present application. As described therein, the portable energy absorbing system, which is operable as an impact attenuation device for reducing the severity of vehicular collisions, comprises guidance frame means, energy absorbing means and impacting plate means. The guidance frame means, which is operable to secure one end of the energy absorbing system in fixed relation to a vehicle, includes an attachment plate through which the guidance frame means is fastened at one end to the aforesaid vehicle, structural tubing members having one end thereof secured to the attachment plate, first support means operable for supporting the structural tubing members and for securing the other end of the structural tubing members to the aforesaid vehicle, and reinforcing means mounted on the structural tubing members operable to provide additional structural strength to the structural tubing members. The energy absorbing means, which functions to absorb the energy release during the vehicular collision, includes a multiplicity of pipe sections connected together in series relation and supported in interposed relation between the guidance frame means and the impacting plate means. The impacting plate means, which is the portion of the energy absorbing system designed to be struck during the vehicular collision, includes a reinforced plate member, structural members having one end thereof supported in sliding relation within the structural tubing members of the guidance frame means, and second support means having one end fastened to the aforesaid vehicle operable to provide additional vertical support to the energy absorbing system relative to the aforereferenced vehicle.

Continuing with the discussion of the second class of protective devices as the latter has been defined hereinbefore, the nature of the immovable objects which are being referred to herein are such things as bridge piers, light stanchions, guardrails, signposts, concrete walls and abutments, etc. Typically, an attempt is made to provide protection against a moving vehicle striking such immovable objects by positioning a stationary traffic safety barrier in proximity to the immovable object and so that it lies along the path, which the moving vehicle would most likely follow if it were to strike the immovable object. Such stationary traffic safety barriers are most often intended to function in the manner of an impact attenuation device; namely, to attenuate the forces produced as a result of the impact of the moving vehicle striking the immovable object and thereby reduce the severity of the vehicular collision as relates to the extent of injury suffered by the individuals riding in the moving vehicle and the amount of property damage incurred by both the moving vehicle and the immovable object.

For ease of reference during the following discussion, such stationary traffic safety barriers will hereinafter be referred to as stationary energy absorbing barriers. One of the earliest attempts made at providing a stationary energy absorbing barrier involved the employment of a system composed of fifty-five gallon drums. Patterns were cut into the lids of the drums to reduce the crushing strength of the system, i.e., to provide the system with the desired controlled crushing characteristics.

The successful implementation of this fifty-five gallon drum modular crash cushion system prompted a study of the feasibility of employing other possible forms of stationary energy absorbing barriers. In this regard, corrugated steel pipe was found to have favorable characteristics when it was statically crash tested. Moreover, the availability of corrugated steel pipe having a wide range of thickness and diameter dimensions made it feasible to employ a polymodular design in which the physical characteristics of the stationary energy absorbing barrier could be varied on a row to row basis.

Examples of other forms of stationary energy absorbing barriers, which are known to exist in the prior art, include the following: a hydro cushion cell barrier composed of an array of water filled plastic cells operable such that upon impact, the water is ejected through orifices in the top of the cells at a controlled rate; a barrier formed by an array of nine to seventeen sand-filled frangible plastic barrels, which is characterized by its versatile applicability; a U-shaped tubular guardrail energy absorbing barrier that absorbs energy by means of the motion of supporting telescopic tubes such that upon impact, the impact forces are transmitted axially to arms, which contain many stainless steel torus elements that are squeezed between two cylindrical tubes; a barrier in the form of a vehicle arresting system that is composed of a steel entrapping net positioned across a roadway, and which is particularly applicable for use in proximity to locations such as road dead ends, ferry landings, highway medians at bridge overpasses, etc.; a lightweight cellular concrete crash cushion barrier constructed of easily frangible vermiculite concrete with vertical voids wherein the vertical voids contribute to the controlled crushing characteristics of the barrier; honeycomb cells that are filled with polyurethane foam; in other instances the honeycomb cells are themselves made of aluminum; for use primarily as part of a guardrail system, a barrier based on a fragmenting tube concept, which was originally developed for use in planned lunar landing modules, and in which energy is absorbed by forcing a thick walled aluminum tube over a flared die, resulting in the shedding of the tube into small segments; and lastly, an energy absorbing barrier particularly applicable for use as part of a guardrail system and in which thick walled steel rings are utilized.

In summary, widespread use is currently being made of crash cushions in the United States as a means of bringing the errant vehicles to a controlled stop when the crash cushions are impacted head-on. Under side impact conditions, systems using fender panels redirect the errant vehicle, even when impacting near the front of the device. On the other hand, sand-barrel crash cushions provide almost no redirection and therefore offer inadequate protection when the center of the vehicle is directed at the corner of the roadway hazard.

A need has thus been evidenced for a new and improved form of impact attenuation system, and in particular a new and improved form of impact attenuation system of the stationary type which would be operative to afford protection in the event that an errant vehicle were to otherwise strike an immovable object. There are a number of characteristics, which it is desired that such a new and improved stationary impact attenuation system should possess. Namely, the system should be operative to trap the errant vehicle when the errant vehicle impacts the system on the side thereof, unless the point of impact of the errant vehicle on the system is so close to the back of the system that significant energy dissipation and acceptable deceleration responses are unobtainable due to the proximity of the hazard. Only under such circumstances should the stationary impact attenuation system be operative to redirect the vehicle. As such, the stationary impact attenuation system should possess the capability of being operative to either entrap the errant vehicle or redirect the errant vehicle depending upon the point of impact of the errant vehicle on the system. In addition, the stationary impact attenuation system should be capable of satisfying the applicable performance standards as outlined in TRC 191 and NCHRP 230. Moreover, the stationary impact attenuation system should be capable of being constructed from readily available materials, should be inexpensive to construct and maintain, and should be inexpensive to repair after having been struck by an errant vehicle. Also, use of the stationary impact attenuation system should not be unduly limited because of considerations of terrain, etc. Finally, the stationary impact attenuation system should be characterized by the fact that when struck by an errant vehicle there is no flying debris associated with the crash event.

It is, therefore, an object of the present invention to provide a new and improved form of impact attenuation system operable to reduce the severity of vehicular collisions.

It is another object of the present invention to provide such an impact attenuation system, which is particularly suited for employment as a stationary system to afford protection to immovable objects from otherwise being struck by an errant vehicle.

A further object of the present invention is to provide such a stationary impact attenuation system, which is operative, depending upon the point of impact therewith by an errant vehicle, to entrap the errant vehicle striking the system.

A still further object of the present invention is to provide such a stationary impact attenuation system, which is operative, depending upon the point of impact therewith by an errant vehicle, to redirect the errant vehicle striking the system.

Yet another object of the present invention is to provide such a stationary impact attenuation system which is capable of satisfying the applicable impact performance standards as outlines in TRC 191 and NCHRP 230.

Yet still another object of the present invention is to provide such a stationary impact attenuation system, the use of which is not unduly limited because of considerations of terrain, etc.

Yet a further object of the present invention is to provide such a stationary impact attenuation system which is characterized by the fact that when struck by an errant vehicle there is no flying debris associated with the crash event.

Yet a still further object is to provide such a stationary impact attenuation system which is capable of being constructed of readily available materials, and is inexpensive to repair after having been struck by an errant vehicle.

SUMMARY OF THE INVENTION

In accordance with the present invention there is provided a new and improved impact attenuation system, which is operative as a stationary system to reduce the severity on the Nation's major highway as well as its local roads of collisions between errant vehicles and immovable objects. The subject stationary impact attenuation system comprises a multiplicity of tubular members, a concrete pad, a backup structure, a plurality of steel skids, and a cover member. In accord with the best mode embodiment of the invention, the multiplicity of tubular members comprise fourteen in number, each being fabricated from straight steel plate sections. These fourteen tubular members are suitably bolted together and are suitably made to rest on the concrete pad. For purposes of enabling the subject system to redirect an errant vehicle which strikes the system near the rear thereof, steel tension straps which are ineffective under compression loading, are employed. The steel tension straps and the compression pipes are operative to form a bracing system whereby the subject stationary impact attenuation system will respond, when struck near the rear thereof by an errant vehicle, in a stiff manner thereby providing the necessary lateral force to redirect the errant vehicle. On the other hand, the tubular members retain their unstiffened response when the subject stationary impact attenuation system is crushed as a consequence of being struck away from the rear thereof by an errant vehicle. The backup structure is designed to be strong enough to withstand the impact force levels associated with vehicular collisions involving high speed, heavy vehicles weighing on the order of 4500 pounds and moving at a speed of 60 MPH. Means are provided for fastening selected ones of the tubular members to the backup structure. The plurality of steel skids are designed to be positioned under the tubular members to minimize frictional forces when the tubular members are subjected to being collapsed as a result of the subject system being struck by an errant vehicle. The cover member, which preferably takes the form of a vinyl-coated nylon nonlaminated member is designed to prevent a buildup during winter of snow and ice on the other components that comprise the subject stationary impact attenuation system.

DESCRIPTION OF A PREFERRED EMBODIMENT

Figure 1:
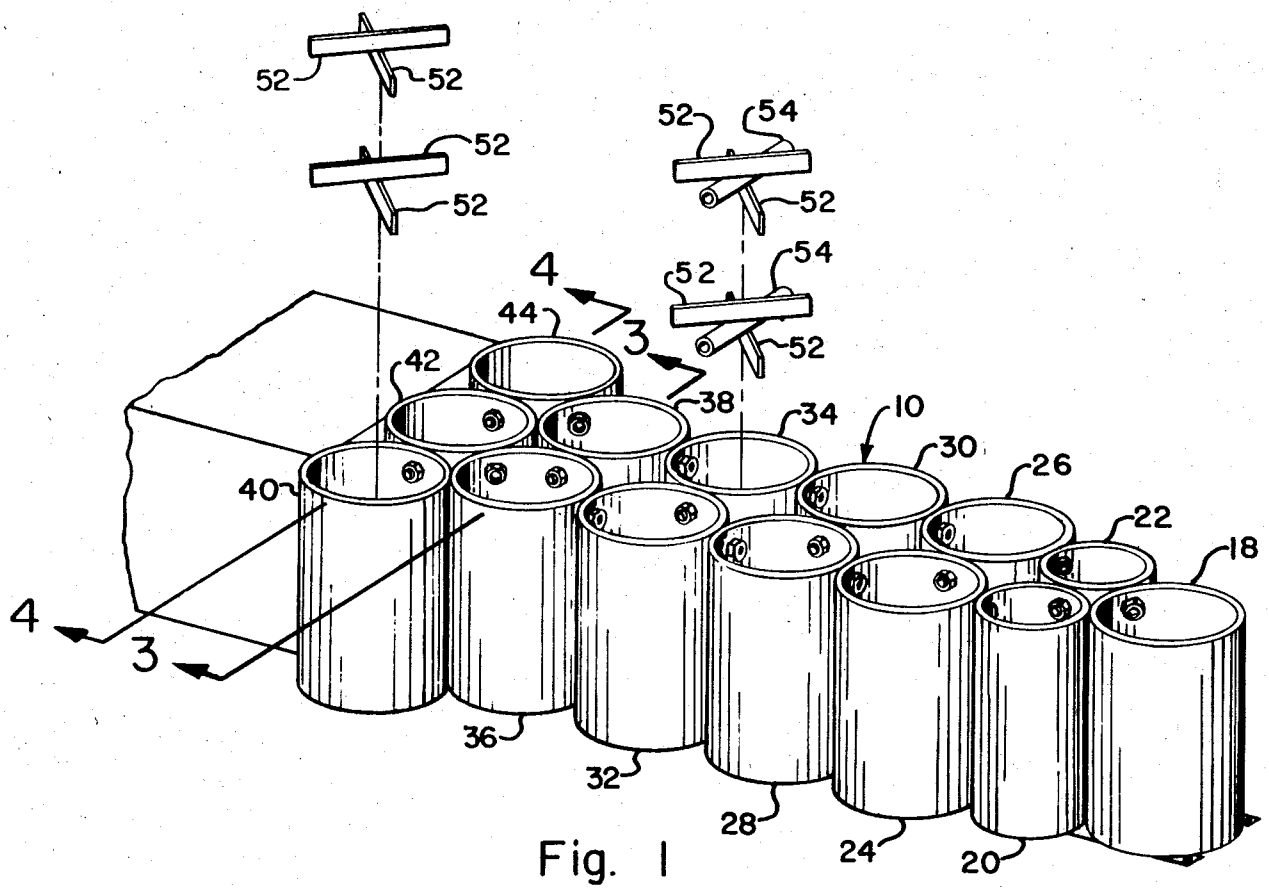
FIG. 1 is a partially exploded perspective view, with some parts omitted for purposes of maintaining therein clarity of illustration, of a stationary impact attenuation system constructed in accordance with the present invention.

Referring now to the drawing, and more particularly to FIG. 1 thereof, there is illustrated therein a stationary impact attenuation system, generally designated by the reference numeral 10, constructed in accordance with the present invention. When deployed in the manner shown in FIG. 1, the stationary impact attenuation system 10 is designed to be operative to reduce the severity of collisions between errant vehicles and immovable objects. To this end, depending upon the point at which the errant vehicle impacts the stationary impact attenuation system 10, the impacting vehicle will, in a manner yet to be described, either be entrapped by the stationary impact attenaution system 10 or be redirected by the stationary impact attenuation system 10. Further, in order to be capable of functioning in such a manner, the stationary impact attenuating system 10 preferably is emplaced in front of the immovable object and in juxtaposed relation thereto such that the stationary impact attenuation system 10 lies between the immovable object and an oncoming errant vehicle.

Figure 2:
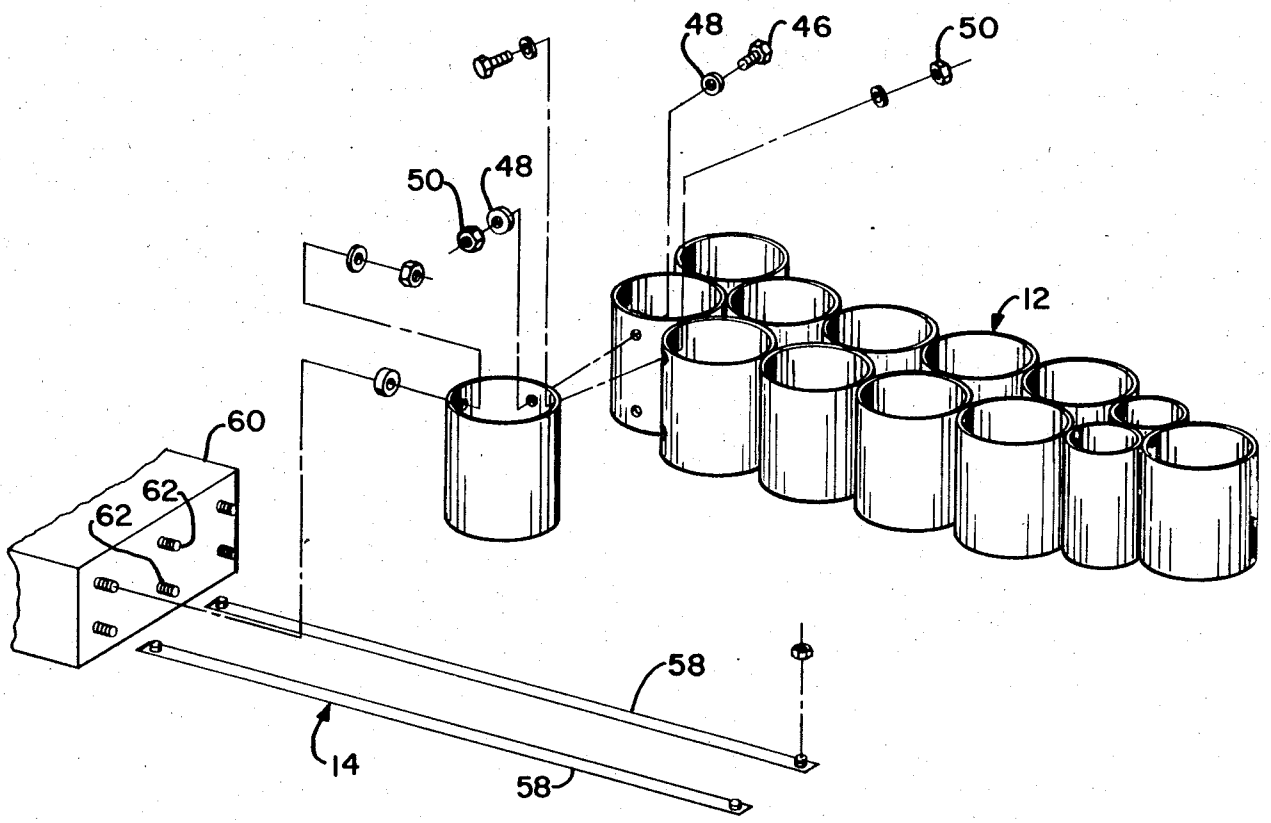
FIG. 2 is an exploded view of the stationary impact attenuation system of FIG. 1, constructed in accordance with the present invention.

As best understood with reference to FIG. 2 of the drawing, the stationary impact attenuation system 10 in accord with the best mode embodiment of the invention is composed of three major components; namely, impact attenuating means, generally designated by the reference numeral 12, support means, generally designated by the reference numeral 14, and protective means, generally designated by the reference numeral 16. It is important to note here that in order to ensure that the stationary impact attenuation system 10 possesses the desired impact attenuating characteristics, it is essential that there exists a predetermined interrelationship between all three of the major components of which the stationary impact attenuation system 10 is composed. The nature of this interrelationship will be described herein more fully subsequently.

A detailed description will now be had of each of the three major components of the stationary impact attenuation system 10 commencing with the impact attenuation means 12. For this purpose, reference will be had in particular to FIGS. 1, 2, 3*a* and 3*b*, and 4*a* and 4*b* of the drawing. When constructed as shown therein, the impact attenuating means 12 is designed to be operative to attenuate the impact caused by an errant vehicle striking the stationary impact attenuation system 10. To accomplish this, the impact attenuating means 12 in accordance with the best mode embodiment of the invention is composed of a multiplicity of tubular members that are suitably arranged in a plurality of rows.

Continuing, as best understood with reference to FIGS. 1 and 2 of the drawing, the multiplicity of tubular members consist of fourteen tubular members that are positioned in a total of seven rows. More specifically, the fourteen tubular members are suitably arranged in the seven rows such that in a first one of the seven rows there is positioned one tubular member, which is denoted in the drawing by the reference numeral 18. In each of the next five of the seven rows there are positioned two tubular members, which are denoted in the drawing by the reference numerals 20 and 22, 24 and 26, 28 and 30, 32 and 34, and 36 and 38, respectively. Lastly, in the final one of the seven rows there are positioned three tubular members, which are denoted in the drawing by the reference numerals 40, 42 and 44.

The tubular members 18, 20, 22, 24, 26, 30, 32, 34, 36, 38, 40, 42 and 44 are suitably arranged relative to each other such that those tubular members which adjoin one another not only physically engage each other, but are also securely fastened to each other. The fastening of adjoining tubular members one to another may be accomplished through the use of any conventional form of fastening means suitable for use for this purpose, one such form of fastening means can be found depicted in FIGS. 1 and 2 of the drawing. As illustrated therein, adjoining ones of the tubular members 18, 20, 22, 24, 26, 28, 30, 32, 34, 36, 38, 40, 42 and 44 are preferably secured one to another through the use of fasteners 46, washers 48, and nuts 50. The adjoining ones of the tubular members 18, 20, 22, 24, 26, 28, 30, 32, 34, 36, 38, 40, 42 and 44 are preferably attached to one another both at the top and at the bottom of each tubular member; namely, at a point spaced approximately eight inches from the top of the tubular member and at a point spaced a like distance, i.e., eight inches, from the bottom of the tubular member. When secured together in the aforementioned fashion, the fourteen tubular members 18, 20, 22, 24, 26, 28, 30, 32, 34, 36, 38, 40, 42 and 44 form an integral assembly.

In accordance with the best mode embodiment of the invention, the tubular members 18, 20, 22, 24, 26, 28, 30, 32, 34, 36, 38, 40, 42 and 44 preferably are each formed from straight steel plate sections, and with all but the tubular members 20 and 22 being fabricated of A-36 steel. The tubular members 20 and 22 are fabricated from M1020 which conforms to ASTM 576. Furthermore, from a dimensional standpoint all of the tubular members 18, 20, 22, 24, 26, 28, 30, 32, 34, 36, 38, 40, 42 and 44 are each four feet in height and each have an outside diameter of three feet. As regards wall thickness, the tubular members 40, 42 and 44 each have a wall thickness of one-fourth inch; the tubular members 36 and 38 each have a wall thickness of five-sixteenths inch; the tubular members 18, 24, 26, 30, 32 and 34 each have a wall thickness of three-sixteenths inch; and the tubular members 20 and 22 are each fabricated from eight gage material.

For purposes of accomplishing the entrapment or redirection of the errant vehicle depending upon the point at which the stationary impact attenuation system 10 is struck by the errant vehicle, the impact attenuating means 12 is provided with a bracing system that functions in a manner to be more fully described hereinafter. The bracing system to which reference is had here is embodied in those tubular members, which occupy the last three of the seven rows of tubular members, as viewed with reference to FIGS. 1 and 2 of the drawing, i.e., tubular members 32, 34, 36, 38, 40, 42 and 44. In accord with the best mode embodiment of the invention, the bracing system comprises a plurality of straps 52 and a plurality of pipes 54 that are suitably secured in a predetermined fashion within the interior of respective ones of the tubular members 18, 20, 22, 24, 26, 28, 30, 32, 34, 36, 38, 40, 42 and 44 such as to bear a specific relationship with regard thereto. To this end, the straps 52 are categorized as being tension straps inasmuch as they are ineffective under compression. Similarly, the pipes 54 are categorized as being compression pipes inasmuch as they are ineffective under tension.

With reference in particular to FIGS. 2, 3*a* and 3*b*, and 4*a* and 4*b* of the drawing, a description will now be had of the manner in which the tension straps 52 and the compression pipes 54 are emplaced within the interior of respective ones of the tubular members 18, 20, 22, 24, 26, 28, 30, 32, 34, 36, 38, 40, 42 and 44. Each of the tubular members 32, 34, 36, 38, 40, 42 and 44 is provided with the tension straps 52, whereas only the tubular members 32, 34, 36, 38 are provided with the compression pipes 54.

Commencing first with a description of the compression pipes 54, the latter in accord with the best mode embodiment of the invention consist of standard weight, schedule 40, steel pipe, which has an internal diameter of one and one-half inches. Each of the tubular members 32, 34, 36 and 38 is provided with a pair of compression pipes suitably spaced one from another but extending parallel to each other within the interior of the respective one of the tubular members 32, 34, 36 and 38. More specifically, each pair of compression pipes 54 in accord with the best mode embodiment of the invention is emplaced within the interior of each of the tubular members 32, 34, 36 38 such that, as best understood with reference to FIG. 3*a* of the drawing, one compression pipe 54 is located approximately eighteen inches from the top of the tubular member and the other compression pipe 54 is located approximately eighteen inches from the bottom of the tubular member. Moreover, for purposes of securing each compression pipe 54 within a respective one of the tubular members 32, 34, 36 and 38, in accord with the best mode embodiment of the invention only one end of the compression pipe 54 is welded to the inside wall of the tubular member. Further, in accordance with the best mode embodiment of the invention, the compression pipes 54 are made to bear a specific relationship relative to the interior of the tubular members within which the compression pipes 54 are emplaced. Namely, each compression pipe 54 is suitably emplaced within a respective one of the tubular members 32, 34, 36 and 38 such that the compression pipe 54 extends substantially perpendicular to the major axis of the impact attenuating means 12, i.e., substantially perpendicular to a line drawn in the direction in which the seven rows of tubular members extend.

Focusing attention next on the tension straps 52, the latter in accord with the best mode embodiment of the invention are each fabricated from steel. Moreover, each tension strap 52 is of a sufficient length so as to span the interior of a respective one of the tubular members 32, 34, 36, 38, 40, 42 and 44, and has a width of five inches and a thickness of one-eighth inch. In the case of the tubular members 32, 34, 36 and 38 there is a pair of tension straps 52 associated with each of the compression pipes 54. Likewise, the tubular members 40, 42 and 44 are each provided with two pairs of tension straps 52. As best understood with reference to FIGS. 3*a* and 3*b* of the drawing, in the case of the tubular members 32, 34, 36 and 38, each pair of tension straps 52 is emplaced therewithin such that one tension strap 52 is located above the compression pipe 54 and the other tension strap 52 is located below the compression pipe 54. In addition, the tension straps 52 are suitably secured within the interior of the tubular members 32, 34, 36 and 38 through the use of any conventional form of securing means (not shown) suitable for use for this purpose, such that the tension straps 52 extend at right angles to each other and at an angle of forty-five degrees to the compression pipe 54 which extends therebetween.

Figure 4B:
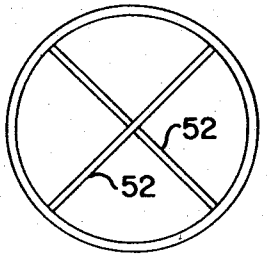
FIG. 4*b* is a top plan view of the tubular member of FIG. 4*a* employed in a stationary impact attenuation system, constructed in accordance with the present invention.
Figure 4A:
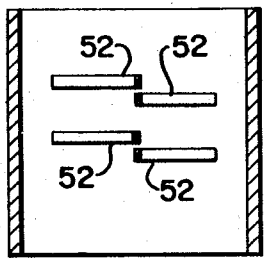
FIG. 4*a* is a cross-sectional view taken along the line 4—4 in FIG. 1 of one of the tubular members employed in a stationary impact attenuation system, constructed in accordance with the present invention.

Similarly, and as will be best understood with reference to FIGS. 4*a* and 4*b* of the drawing, each of the tubular members 40, 42 and 44 is provided in the same manner as the tubular members 32, 34, 36 and 38 with two pairs of tension straps 52 with the exception that no compression pipe 54 is positioned between each two individual tension straps 52 which together comprise a pair thereof. On the other hand, as in the case of the tension straps 52 which are emplaced within the tubular members 32, 34, 36 and 38, the tension straps 52 that are emplaced within the tubular members 40, 42 and 44 are suitably secured within the interior of the latter tubular members through the use of any conventional form of securing means (not shown) suitable for use for this purpose. Moreover, the tension straps 52 that are emplaced within the tubular members 40, 42 and 44 are made to bear the same angular relationship relative to the interior of the tubular members 40, 42 and 44 as that which the tension straps 52 that are emplaced within the tubular members 32, 34, 36 and 38 bear to the interior of the latter tubular members.

A description will now be had of the second major component of the stationary impact attenuation system 10, namely, the support means which is generally designated by reference numeral 14 in the drawing. For this purpose, reference will be had in particular to FIGS. 2 and 5 of the drawing. As will be best understood with reference to the latter two Figures, the support means 14 encompasses the concrete pad seen at 56 in FIG. 5, the pair of skids with each of the latter being designated by the reference numeral 58 in FIG. 2, and the backup structure denoted by the reference numeral 60 in FIG. 2.

Continuing, the concrete pad 56 is suitably configured such that all fourteen of the tubular members 18, 20, 22, 24, 26, 28, 30, 32, 34, 36, 38, 40, 42 and 44 can be positioned thereon. To this end, in accord with the best made embodiment of the invention the concrete pad 56 is preferably made from Class A concrete, is approximately twenty-eight feet long when measured along its major axis, and is approximately six inches thick. The concrete pad 56 is intended to function in the manner of a base for the tubular members 18, 20, 22, 24, 26, 28, 30, 32, 34, 36, 38, 40, 42 and 44. As such, the concrete pad 56 is preferably positioned relative to the surrounding surfaces such that the top surface of the concrete pad 56 is within plus or minus one-eighth inch of the elevation of the surfaces which surround the concrete pad 56.

Next, as regards the pair of skids 58, the latter are each formed from steel, and as best understood with reference to FIG. 2 of the drawing are designed to be emplaced within the stationary impact attenuation system 10 in such a manner that they extend in parallel, spaced relation to one another. In accord with the best mode embodiment of the invention, each of the skids 58 is approximately twenty-five feet five and one-half inches long, two and one-half inches wide, and one-half inch thick. When so constructed, the pair of skids 58 are designed to be positioned under the tubular member 18, 20, 22, 24, 26, 28, 30, 32, 34, 36, 38, 40, 42 and 44 whereby the pair of skids 58 is operative to minimize frictional forces when the tubular members 18, 20, 22, 24, 26, 28, 30, 32, 34, 36, 38, 40, 42 and 44 undergo movement as a consequence of the impact forces that are produced when the stationary impact attenuation system 10 is struck by an errant vehicle. For purposes of performing their intended function, it is important that each of the skids 58 is protected from corrosion and rust buildup. This is to ensure that low frictional resistance will exist when there is movement of the tubular members 18, 20, 22, 24, 26, 28, 30, 32, 34, 36, 38, 40, 42 and 44.

The final component, yet to be described, of the support means 14 is the backup structure 60. The latter structure 60 may take a variety of forms consistent with retaining the capability thereof to accomplish the function which it is desired to have the backup structure 60 accomplish; namely, that of a support structure. By way of exemplification and not limitation, one form of backup structure 60 has been depicted in the drawing. More specifically, as best understood with reference to FIGS. 1 and 2 of the drawing, the backup structure 60 comprises a suitably dimensioned, concrete wall-like structure having a plurality of fasteners 62 projecting therefrom. The fasteners 62 are intended to be employed for purposes of fastening the tubular members 40, 42 and 44 to the backup structure 60. To this end, the fasteners 62 may comprise any conventional form of fastening means suitable for use for the aforedescribed purpose. Insofar as concerns the particular form which the backup structure 60 should embody, the characteristics of the specific site at which the stationary impact attenuation system 10 is intended to be emplaced will play a prominent role in establishing what form the backup structure 60 will take. That is, the backup structure 60 must be strong enough to withstand the impact forces associated with high speed, heavy vehicle, i.e., vehicles weighing on the order of forty-five hundred pounds and traveling at a speed of sixty miles per hour, collisions. As such, in accord with the best mode embodiment of the invention, the points of connection of the tubular members 40, 42 and 44 to the backup structure 60 are made at a point located eight inches from the top of and eight inches from the bottom of each of the tubular members 40, 42 and 44.

Figure 5:
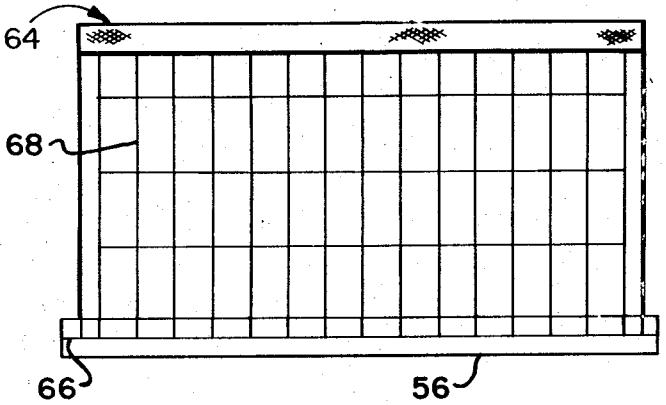
FIG. 5 is a rear view with parts broken away of a stationary impact attenuation system constructed in accordance with the present invention.
Figure 3B:
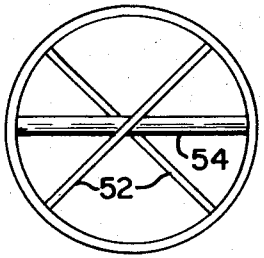
FIG. 3*b* is a top plan view of the tubular member of FIG. 3*a* employed in a stationary impact attenuation system, constructed in accordance with the present invention.
Figure 3A:
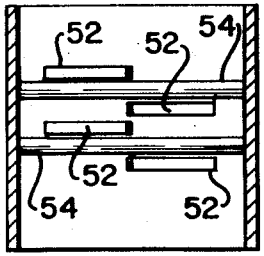
FIG. 3*a* is a cross-sectional view taken along the line 3—3 in FIG. 1 of one of the tubular members employed in a stationary impact attenuation system, constructed in accordance with the present invention.

Turning now to a description of the third major component of the stationary impact attenuation system 10, i.e., the protective means 16, reference will be had for this purpose principally to FIG. 5 of the drawing. As will be best understood with reference to the latter Figure of the drawing, the protective means 16 includes a protective cover, generally designated by the reference numeral 64. The protective cover 64, in accord with the best mode embodiment of the invention, comprises a vinylcoated, nonlaminated nylon of a suitable color such as black, weighing eighteen oz/sy, and having a tensile strength of four hundred pounds per square inch. Further, the protective cover 64 should be capable of resisting a hydrostatic pressure of up to six hundred pounds per square inch, and remain stable and flexible within the temperature range from −40° F. to 180° F. The protective cover 64 is designed to be operative to prevent buildup within the tubular members 18, 20, 22, 24, 26, 28, 30, 32, 34, 36, 38, 40, 42 and 44 of materials such as snow and ice in winter, etc. To this end, the protective cover 64 is suitably dimensioned so that when emplaced on the tubular members 18, 20, 22, 24, 26, 28, 30, 32, 34, 36, 38, 40, 42 and 44 in the manner depicted in FIG. 5 of the drawing, the protective cover 64 not only spans the tops of all fourteen of the tubular members 18, 20, 22, 24, 26, 28, 30, 32, 34, 36, 38, 40, 42 and 44 but also extends downwardly along the sides of the tubular members 18, 20, 22, 24, 26, 28, 30, 32, 34, 36, 38, 40, 42 and 44 for a suitable distance much in the manner of a hem. Any suitable conventional form of fastening means (not shown) may be employed for purposes of securing the protective cover 64 in place relative to the tubular members 18, 20, 22, 24, 26, 28, 30, 32, 34, 36, 38, 40, 42 and 44. One such conventional form of fastening means (not shown) which has been found suitable for use for the aforereferenced purpose is that of pop rivets which are made to pass through the hem portion of the protective cover 64 at all points of tangency thereof with the tubular members 18, 20, 22, 24, 26, 28, 30, 32, 34, 36, 38, 40, 42 and 44.

For purposes of completing the description of the stationary impact attenuation system 10, reference will once again be had to FIG. 5 of the drawing. As depicted therein, the concrete pad 56 preferably has embedded therein steel reinforcement members, which have been identified in FIG. 5 by the reference numeral 66. Likewise, the backup structure 60 also preferably has embedded therein steel reinforcement members, which have been designated by the reference numeral 68 in FIG. 5. The purpose behind embedding the steel reinforcement members 66 and 68 in the concrete pad 56 and in the backup structure 60, respectively, is to provide additional strength thereto. That is, in accord with convential practice the steel reinforcement members 66 and 68 serve to provide the concrete pad 56 and the backup structure 60, respectively, with additional reinforcement.

Figure 6:
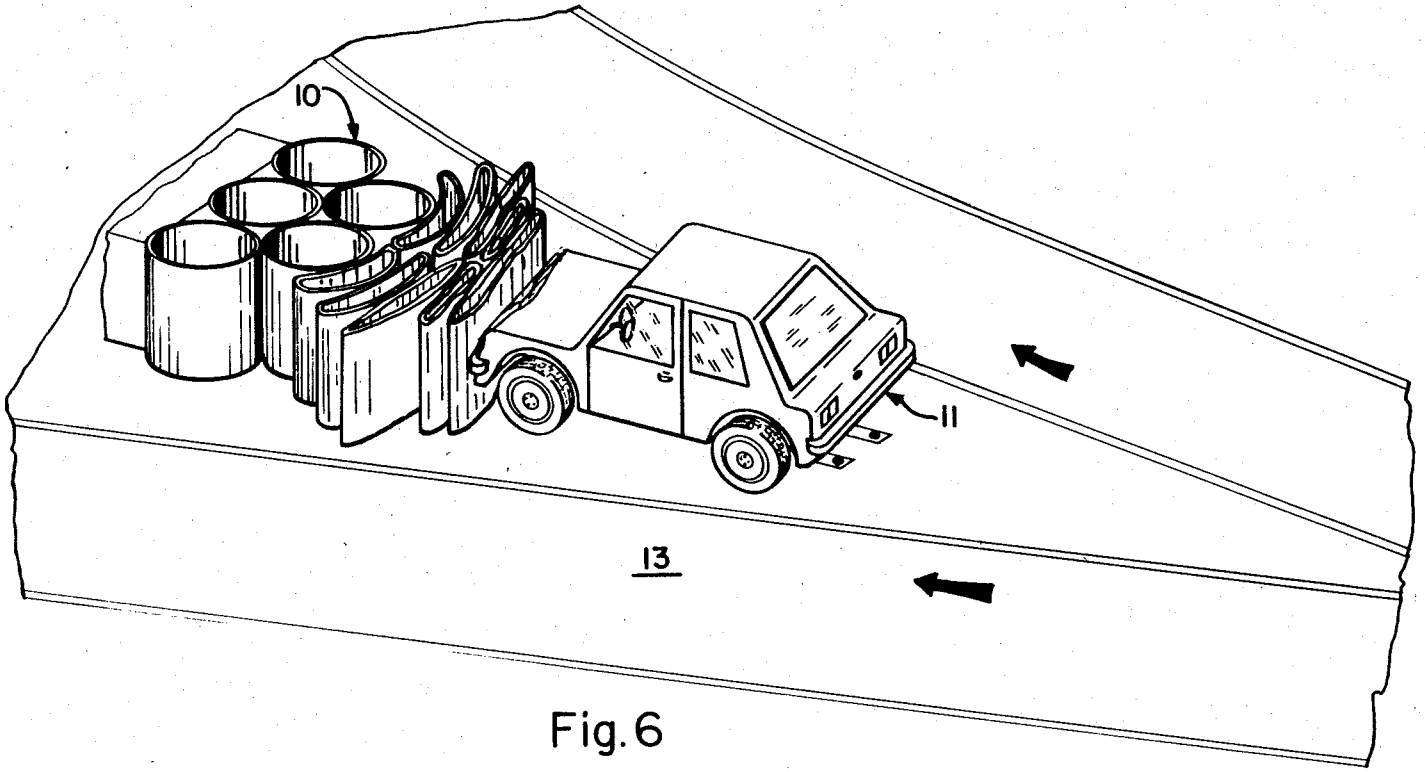
FIG. 6 is a schematic representation of a vehicle impacting against a stationary impact attenuation system constructed in accordance with the present invention illustrating the post-impact positions of the impacting vehicle and the major components of the stationary impact attenuation system wherein when the point of impact is other than near the rear of the stationary impact attenuation system the impacting vehicle is entrapped by the stationary impact attenuation system.
Figure 7:
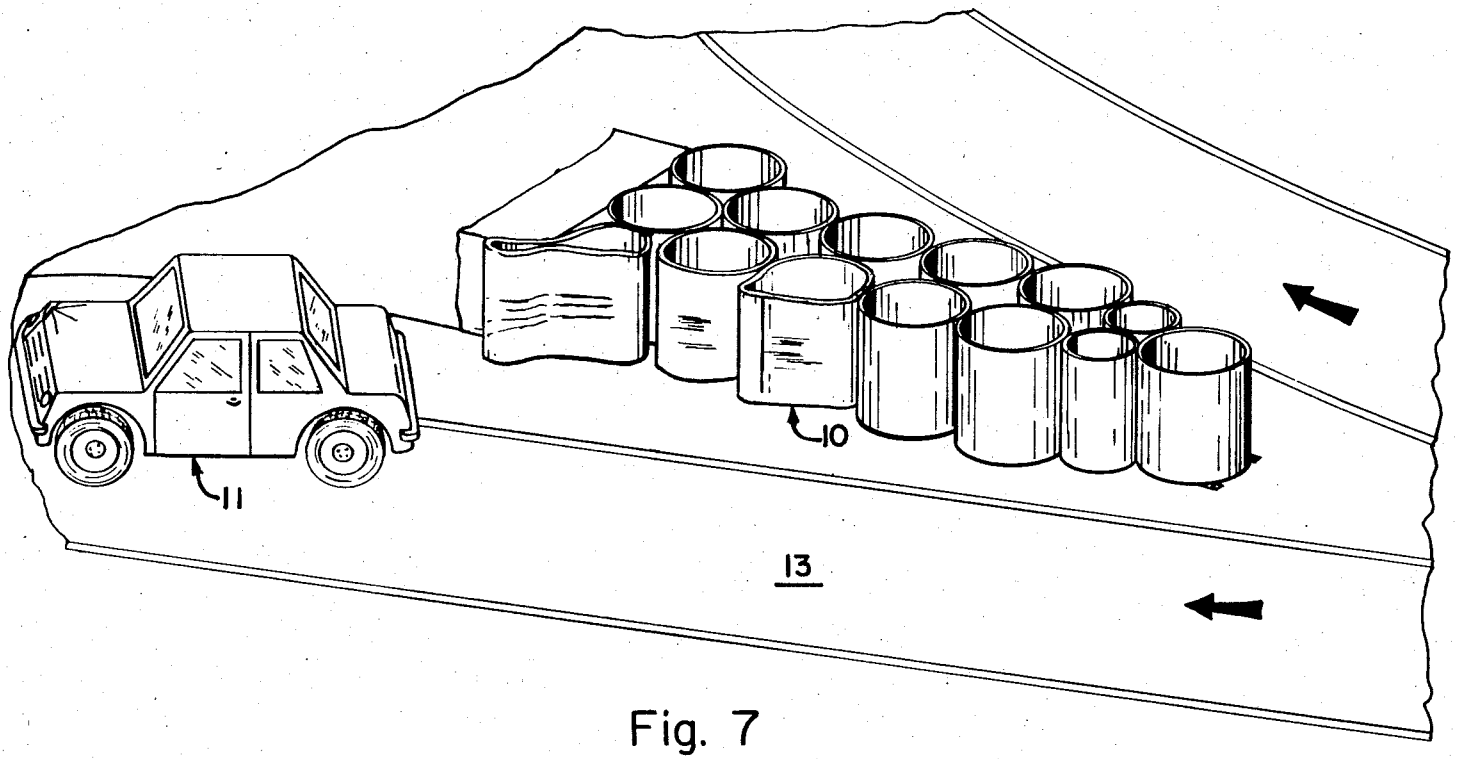
FIG. 7 is a schematic representation of a vehicle impacting against a stationary impact attenuation system constructed in accordance with the present invention illustrating the post-impact positions of the impacting vehicle and the major components of the stationary impact attenuation system wherein when the point of impact is near the rear of the stationary impact attenuation system the impacting vehicle is redirected by the stationary impact attenuation system.

By way of summary, therefore, the nature of the construction of the stationary impact attenuation system 10 as described hereinbefore is such as to provide the stationary impact attenuation system 10 with the following mode of operation. That is, in accord with the best mode embodiment of the invention the stationary impact attenuation system 10 includes fourteen tubular members 18, 20, 22, 24, 26, 28, 30, 32, 34, 36, 38, 40, 42 and 44, which are bolted together to form a cluster, and which rest on a concrete pad 56, and which are attached to an appropriate backup structure 60. As schematically represented in FIG. 6 of the drawing, the stationary impact attenuation system 10 under most impact conditions will trap the errant vehicle 11 which strikes the stationary impact attenuation system 10. Only when the impact location, as schematically represented in FIG. 7 of the drawing, is so close to the rear of the stationary impact attenuation system 10 that an acceptable energy dissipation/deceleration trapping response is unobtainable due to the proximity of the site hazard, which the stationary impact attenuation system 10 is designed to prevent from being struck by an errant vehicle 11, will the stationary impact attenuation system 10 function to redirect the errant vehicle 11 striking the stationary impact attenuation system 10 back out into the roadway 13. To this end, the stationary impact attenuation system 10 embodies a bracing system comprised of steel tension straps 52 which are ineffective under compression loading and compression pipes 54 which are ineffective in tension. This bracing system ensures that the crash cushion, i.e., the tubular members 18, 20, 22, 24, 26, 28, 30, 32, 34, 36, 38, 40, 42 and 44, will respond in a stiff manner when subjected to an oblique impact by an errant vehicle near the rear of the stationary impact attenuation system 10 thereby providing the necessary lateral force to redirect the errant vehicle. On the other hand, the braced tubular members 32, 34, 36, 38, 40, 42 and 44 retain their unstiffened response when the stationary impact attenuation system 10 is struck by an errant vehicle which impacts the stationary impact attenuation system 10 elsewhere than near the rear thereof. However, it must be recognized that the effective performance of the stationary impact attenuation system 10 under impact conditions is dependent on the appropriate interaction of the three major components, i.e., the impact attenuating means 12, the support means 14 and the protective means 16, of the stationary impact attenuation system 10 with the surrounding at the site at which the stationary impact attenuation system 10 is emplaced.

The stationary impact attenuation system 10 is designed so that the tubular members 18, 20, 22, 24, 26, 28, 30, 32, 34, 36, 38, 40, 42 and 44 can be reused, even after an impact causing severe collapse of the system 10. To this end, using appropriate machinery individual tubular members 18, 20, 22, 24, 26, 28, 30, 32, 34, 36, 38, 40, 42 and 44 can be reshaped with an attendant fifty percent savings in material costs. As such, this capability of the stationary impact attenuation system 10 to be reused has the effect of significantly extending the service life of the stationary impact attenuation system 10.

Thus, in accordance with the present invention there has been provided a new and improved form of impact attenuation system operable to reduce the severity of vehicular collisions. The impact attenuation system of the present invention is particularly suited for employment as a stationary system to afford protection to immovable objects from otherwise being struck by an errant vehicle. In accord with the present invention, the stationary impact attenuation system is operative, depending upon the point of impact therewith by an errant vehicle, to entrap the errant vehicle striking the system. In addition, the stationary impact attenuation system of the present invention is operative, depending upon the point of impact therewith by an errant vehicle, to redirect the errant vehicle striking the system. Moreover, in accordance with the present invention a stationary impact attenuation system is provided which is capable of satisfying the applicable impact performance standards as outlined in TRC 191 and NCHRP 230. Also, the stationary impact attenuation system of the present invention is advantageously characterized in that the use thereof is not unduly limited because of considerations of terrain, etc. Furthermore, in accord with the present invention a stationary impact attenuation system is provided which advantageously characterized by the fact that when struck by an errant vehicle there is no flying debris associated with the crash event. Finally, the stationary impact attenuation system of the present invention is capable of being constructed of readily available materials, is inexpensive to construct and maintain, and is inexpensive to repair after having been struck by an errant vehicle.

While only one embodiment of my invention has been shown, it will be appreciated that modifications thereof, some of which have been alluded to hereinabove, may be readily made thereto by those skilled in the art. I, therefore, intend by the appended claims to cover the modifications which fall within the true spirit and scope of my invention.

What is claimed is:

1. A stationary impact attenuation system for reducing the severity of vehicular collisions occasioned by an errant vehicle striking an immovable object comprising:

a. support means located in juxtaposed relation to an immovable object and so as to lie between the immovable object and an oncoming errant vehicle, said support means being operative as a support structure;

b. impact attenuating means positioned in supported relation on said support means, said impact attenuating means being selectively operative to entrap an errant vehicle striking the stationary impact attenuation system at a first location and to redirect an errant vehicle striking the stationary impact attenuation system at a second location, said impact attenuating means including a plurality of tubular members arranged in the form of a cluster and bracing means positioned in selective ones of said plurality of tubular members, said bracing means including a pair of compression means positioned in each of certain ones of said selective ones of said plurality of tubular members and a first and a second pair of tension means positioned in at least each of said certain ones of said selective ones of said plurality of tubular members, each of said of compression means being positioned in spaced relation one to another in each of said certain ones of said selective ones of said plurality of tubular members and so as to extend perpendicularly to the major axis of said plurality of tubular members, said first pair of tension means being positioned in each of said certain ones of said selective ones of said plurality of tubular members so as to straddle one of said pair of compression means positioned in each of said certain ones of said selective ones of said plurality of tubular members and so as to extend at an acute angle relative to said one of said pair of compression means, said second pair of tension means being positioned in each of said certain ones of said selective ones of said plurality of tubular members so as to straddle the other one of said pair of compression means positioned in each of said certain ones of said selective ones of said plurality of tubular members and so as to extend at an acute angle relative to said other one of said pair of compression means; and c. protective means positioned in juxtaposed relation to said impact attenuating means, said protective means being operative to prevent a buildup of snow and ice on the other components that comprise the stationary impact attenuation system.

2. The stationary impact attenuation system as set forth in claim 1 wherein each of said pair of compression means comprises a compression pipe.

3. The stationary impact attenuation system as set forth in claim 2 wherein a first and a second pair of tension means are also positioned in the other of said selective ones of said plurality of tubular members and so as to form an acute angle relative to the major axis of said plurality of tubular members.

4. The stationary impact attenuation system as set forth in claim 3 wherein each of said first and second pair of tension means comprises a tension strap, and the acute angle formed by each of said first and second pair of tension straps is an angle of forty-five degrees.

5. The stationary impact attenuation system as set forth in claim 1 wherein adjoining ones of said plurality of tubular members are fastened one to another, and said plurality of tubular members are each capable of being refurbished after the stationary impact attenuation system has been struck by an errant vehicle so as to thereby render them reusable.

6. The stationary impact attenuation system as set forth in claim 5 wherein said plurality of tubular members comprises fourteen tubular members arranged in a total of seven rows such that one of said seven rows contains one of said fourteen tubular members, five of said seven rows each contain two of said fourteen tubular members and one of said seven rows contains three of said fourteen tubular members.

7. The stationary impact attenuation system as set forth in claim 6 wherein said support means includes a concrete pad of sufficient dimensions so as to enable all of said fourteen tubular members to be emplaced thereon.

8. The stationary impact attenuation system as set forth in claim 7 wherein said support means also includes a pair of skids positioned on said concrete pad, said pair of skids extending in spaced parallel relation one to another in the direction of the major axis of said concrete pad, said pair of skids being operative to minimize the frictional forces produced when movement of said fourteen tubular members occurs as a consequence of the stationary impact attenuation system being struck by an errant vehicle.

9. The stationary impact attenuation system as set forth in claim 8 wherein said support means further includes a backup structure located in juxtaposed relation to one end of said concrete pad, said backup structure having at least some of said fourteen tubular members secured thereto, said backup structure having sufficient strength so as to be capable of withstanding the forces produced when the stationary impact attenuation system is struck by an errant vehicle weighing up to forty-five hundred pounds and traveling at a speed of sixty miles per hour.

10. The stationary impact attenuation system as set forth in claim 6 wherein said protective means includes a nonmetallic cover member of sufficient dimensions so as to both span the tops of said fourteen tubular members and provide a hem along at least a portion of the sides of said fourteen tubular members.

* * * * *